United States Patent [19]

Gaiardelli

[11] 4,044,423

[45] Aug. 30, 1977

[54] PNEUMATIC CLEANER PARTICULARLY FOR CLEANING ELEMENTS OF TEXTILE MACHINERY

[76] Inventor: Giuseppe Gaiardelli, via Bertacchi, 15, Parabiago (Prov. of Milan), Italy

[21] Appl. No.: 533,384

[22] Filed: Dec. 16, 1974

[30] Foreign Application Priority Data

Dec. 27, 1973 Italy ..... 32319/73

[51] Int. Cl.[2] ..... A47L 5/18

[52] U.S. Cl. ..... 15/345; 15/409

[58] Field of Search ..... 15/345, 346, 409

[56] References Cited

U.S. PATENT DOCUMENTS

| | | | |
|---|---|---|---|
| 2,154,773 | 4/1939 | Reed | 15/409 X |
| 2,846,710 | 8/1958 | Haka | 15/409 X |
| 2,851,213 | 9/1958 | Swallert | 15/409 X |
| 3,107,386 | 10/1963 | Mandin | 15/409 X |
| 3,683,446 | 8/1972 | Tell | 15/409 X |

FOREIGN PATENT DOCUMENTS

| | | | |
|---|---|---|---|
| 1,022,770 | 1/1958 | Germany | 15/409 |

*Primary Examiner*—Christopher K. Moore
*Attorney, Agent, or Firm*—Guido Modiano; Albert Josif

[57] ABSTRACT

A pneumatic cleaner, particularly for turbines and like elements of textile machines which comprises a suction head, a suction duct communicating at one end with a conical suction mouth defined in the head and on the other end with a collecting container. The suction head has a front surface provided with a step-like annular projection so as to match with the entrance of a turbine or like element of a textile machine and to engage with the turbine entrance geometrically. The cleaner is also provided with a compressed air duct ending with a nozzle inside the suction duct, the nozzle being oriented so as to form a depression and suction in the suction mouth. The head further comprises a first and a second passage each communicating at one end with a source of compressed air and each having at the other end an air blast nozzle ending at the conical mouth of the suction head. The air blast nozzle of the first passage is directed with its axis crossing the axis of the conical mouth at a point outside thereof and the air blast nozzle of the second passage is inclined with respect to the front surface of the head and has an axis skew with respect to the axis of the conical mouth. Combined action of the air blast nozzles creates air movement with a vortical component in the object to be cleaned, thereby causing dust material and the like to be dislodged to the center where suction through said suction mouth is greatest.

1 Claim, 6 Drawing Figures

PNEUMATIC CLEANER PARTICULARLY FOR CLEANING ELEMENTS OF TEXTILE MACHINERY

BACKGROUND OF THE INVENTION

The present invention relates to a pneumatic cleaner particularly for spindles and like elements of textile machinery.

It is known that in textile machines and particularly in their spindles or turbines and like elements, hereinafter generalized as turbines, on which the yarn is twisted in the required way, yarn lint and sand contained in the yarn to be worked, particularly in the case of cotton, we are deposited thereon.

Thereby to ensure a correct operation of said machines and to prevent frequent yarn breakage due to dirty turbines, it is necessary to clean said turbines periodically. In compliance with the instructions issued by the manufacturers of textile machines, it is necessary to clean the turbines every two or three hours by previously interrupting the yarn in order to enter the turbine. Presently the cleaning of the latter is carried out manually with the aid of a brush introduced through a case lid which is generally rotatable by only 45°. This results in an incomplete and rough cleaning and practically a greater part of the dirt removed by the brush is not even eliminated but loosened onto the bottom of the turbine case. It has also been observed that the personnel does not carry out this cleaning operation with the required timeliness and precision, but generally only on occasion of an accidental breakage of the yarn. Furthermore, to carry out the cleaning with a brush, a considerable amount of time is required since the number of turbines provided on a textile machine such as a twisting machine is 200 or more depending upon the length of the twisting machine.

SUMMARY OF THE INVENTION

The basic object of the present invention is to provide a pneumatic cleaner for carrying out a rapid and through cleaning of said turbines and like elements.

In addition the pneumatic cleaner according to the invention must be easily manoeuverable and appliable simply, precisely and rapidly to the entrance opening of the turbines.

These objects are substantially attained by a pneumatic cleaner, particularly for turbines and like elements of textile machines, comprising a suction head, a suction duck ending into a collecting container and a compressed air source, wherein the suction head comprises a projection on a front surface thereof having an annular step-like configuration, said projection matching with the entrance of a turbine so as to engage with the latter geometrically, a rear chamfer in the bottom corner of the head in order to allow application of said suction head to the turbine even when the lid of the turbine is open only by 45°, a conical suction mouth defined at said front surface and communicating with said suction duct, a compressed air duct leading to the suction duct and ending with a nozzle oriented so as to form a suction in said suction mouth, a first compressed air passage having an air blast nozzle ending into said suction mouth, and a second compressed air passage having an air blast nozzle ending into said suction mouth, wherein said air blast nozzle of said first passage has an axis crossing the axis of said suction mouth at a point outside the suction mouth and said air blast nozzle of said second passage has an axis inclined with respect to said front surface and skew with respect to the axis of the conical mouth, whereby a vortical air movement is created inside the turbine causing yarn lint and the like to be dislodged to the center of the turbine where suction through said suction mouth is greatest.

BRIEF DESCRIPTION OF THE DRAWINGS

Further characteristics and advantages of the invention will be more evident from the description of a preferred but not exclusive embodiment of a pneumatic cleaner illustrated by way of a non limiting example in the accompanying drawings in which.

DESCRIPTION OF A PREFERRED EMBODIMENT

Figure 1:
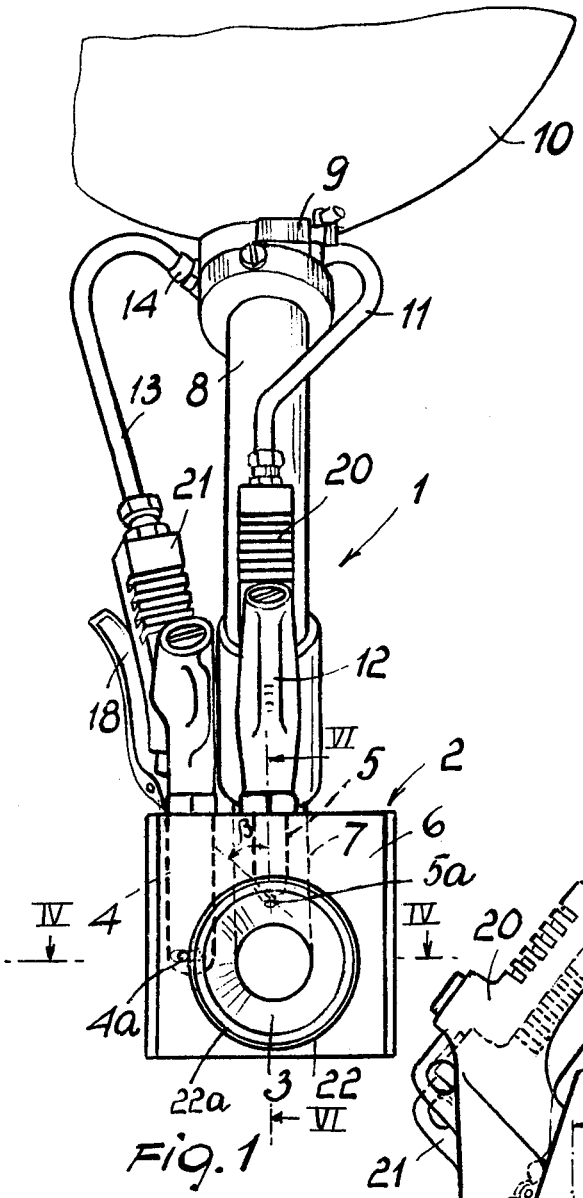
FIG. 1 is a front view of the pneumatic cleaner according to the invention.
Figure 2:
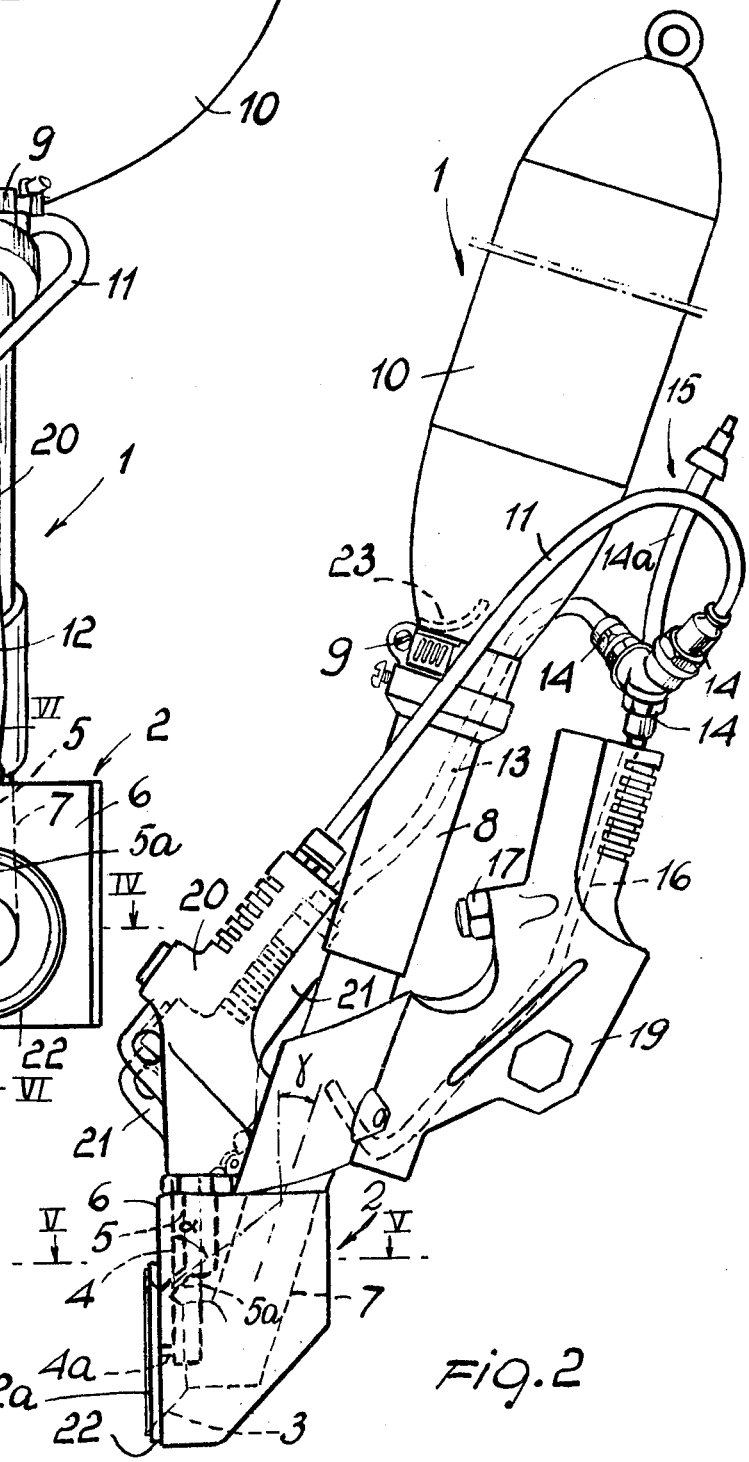
FIG. 2 is an elevated side view of the pneumatic cleaner.
Figure 4:
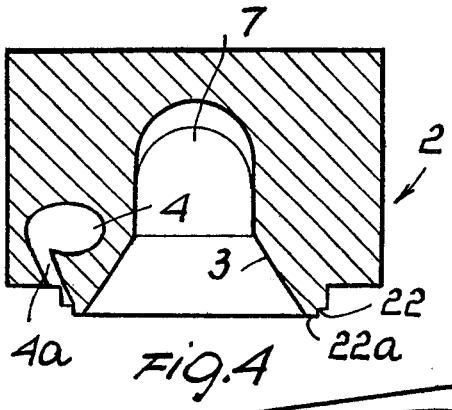
FIGS. 4, 5 and 6 are sections of the suction head taken along lines IV—IV of FIG. 1, V—V of FIG. 2 and VI—VI of FIG. 1, respectively.
Figure 5:
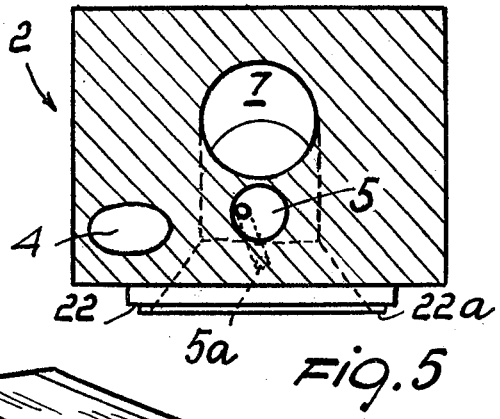
Figure 3:
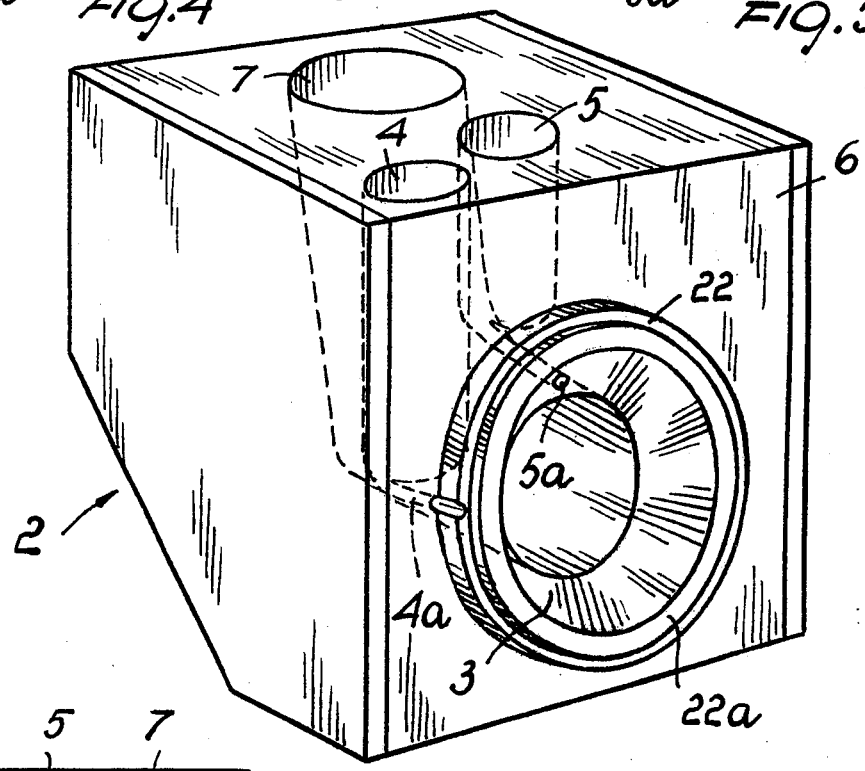
FIG. 3 is a perspective view on an enlarged scale of the suction head showing the arrangement of the air blast nozzles and corresponding passages.
Figure 6:
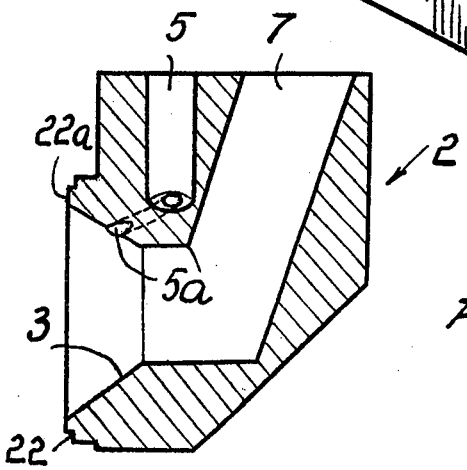

With reference to the above indicated figures, the pneumatic cleaner is indicated overall by the numeral 1. It comprises a suction head 2 in the form of a a metal parallele-piped containing a suction duct 7. As can be seen from the drawings, the suction duct 7 has its outlet on the front surface 6 of the head 2 where it has a conical configuration defining a conical suction mouth 3 sloping from the front surface 6 to the corresponding end of the suction duct 7. The other end of suction duct 7 is connected, through a pipe 8, to a collecting container 10, secured with known means 9 to pipe 8 and provided for receiving the sucked discharge material. The pipe 8 as well as a part of the suction duct 7 have an axis inclined with respect to the front surface 6 of the head 2 by an angle $\alpha$ advantageously of about 19°.

A compressed air duct 16 ends with a nozzle inside the suction duct 7, the nozzle being oriented towards the pipe 8, that is opposite to the suction mouth 3 so as to establish a sucking action in the conical suction mouth 3 and in the suction duct 7. A valve element associated to the compressed air duct 16 for controlling air flow therethrough is indicated with the numeral 17. The duct 16 ends, on the end, opposite to that leading to said nozzle, in one of three branches 14 of a manifold 15 connected through a pipe **14*a*** to a compressed air source not illustrated.

A first passage 4, also for blowing, develops within the head 2 separate from suction duct 7 and has an axis parallel to the front surface 6 of the suction head. The passage 4 extends up to about the half height of the suction mouth 3 and ends with an air blast nozzle **4*a* of smaller diameter than that of passage 4. The nozzle opens substantially at the peripheral portion of the conical suction mouth 3 and has an axis inclined to cross the axis of the suction mouth 3 at a point outside of the suction mouth. It is advantageously suggested to form the outlet of nozzle 4*a* for a half in a projection 22, which will be described below, so as to provide a guiding wall for the air flowing out and to direct it in a convenient inclined sense to the center of the turbine to be cleaned. Said configuration is easily obtained for example by perforating or milling the one half of the circumference of the nozzle 4a to a limited depth, for example about 1.5mm within the wall of the projection 22.**

A pipe 13, leading to one of the branches 14 of the manifold 15, serves for supplying compressed air to said first passage 4 and to air blast nozzle 4a. The numeral 18 indicates the valve means associated to the pipe 13 for controlling air flow through air blast nozzle 4a.

A second passage 5, for blowing, is provided in the suction head 2 separate from passage 4 and suction duct 7 and has an axis parallel to the front surface 6 and radial with respect to the axis of the suction mouth 3. Passage 5 ends in the suction mouth 3 close to the front surface 6 through an air blast nozzle 5a having a diameter preferably of smaller size with respect to that of the passage 5. The nozzle 5a has an axis forming an angle $\alpha$ with the plane of the front surface 6, as well as an angle $\beta$ with a plane including both the axes of passage 5 and of suction mouth 3, so that the axis of nozzle 5a results skew with respect to the axis of the suction mouth 3. In practice good results have been obtained with an angle $\alpha$ of 40° and an angle $\beta$ of 6°. For purposes of clarity the angle $\beta$ in FIG. 1 has been shown far greater than 6°.

A pipe 11 connects passage 5 through a controllable valve means to one of the three branches 14 of the manifold 15.

With the numerals 19, 20 and 21 are respectively indicated the supporting bodies which house the relative ducts and pipes 16, 11 and 13 as well as the respective manually controllable valve means 17, 12 and 18.

On the front surface 6 of the suction head 2, the conical suction mouth 3 is surrounded by an annular projection 22 with a diameter corresponding to the diameter of the entrance opening of the turbine to be cleaned. Furthermore, on the rear end of said head 2 there is provided a chamfer at a 45° angle to permit application of the head 2 to the opening of the turbine even in the case that its lid may be opened only by 45°. Moreover, for the purpose of improving the geometric engagement between the cleaner and the respective turbine, an annular rim 22a, having a contour similar to the internal contour of the turbine, may be provided on the projection 22. In this manner air escape is avoided during operation.

The numeral 23 indicates a non return valve, preferably of the type having a mobile rubber elastic membrane or of any other similar elastic material. Said valve is situated at the end of the pipe 8 on the side of the sack 10. The way the valve is fixed is not further illustrated since it may be carried out as desired with means well known per se.

The operation of the pneumatic cleaner according to the invention is the following.

After opening the lid of the turbine and applying the cleaner according to the invention, a suction will first be carried out and then a blowing action, both started and controlled by acting on the control valves 17, 12, 18 of the respective compressed air ducts. The compressed air blown into the casing of the turbine directionally depending upon the inclination of the outlet nozzle 4a of the first passage 4, surely removes all the lint and cotton and fibrous residue deposited inside the turbine, these then being removed by suction taking place in the suction mouth 3 and being conveyed through pipe 8 into sack 10. In its turn the compressed air flowing through the nozzle 5a of second passage 5 helps to loosen the fibrous particles from the turbine and to convey them to the suction mouth due to the vortical air movement resulting from the orientation of nozzle 5a. The nonreturn valve 23 prevents the dirt and the lint from falling back into the turbine along the pipe 8 once they have reached the sack 10.

The time required for cleaning a turbine is in the order of about a few seconds. The cleaning obtainable is optimal without any residue.

With the pneumatic cleaner according to the invention requiring only one compressed air source, a compressed air pipe may be easily provided extending upwards above the textile machines, such as twisting machines or the like, so that the pneumatic cleaner may be conveniently operated as aerially suspended equipment which can move along the length of the machine to be cleaned. Obviously, in the case of machines having a considerable length, two or more of such cleaners may be provided.

From the above description, it is evident that the pneumatic cleaner according to the invention attains the stated objects, in that it ensures a complete and rapid cleaning and permits its use and application to the openings of the turbines with great ease.

The invention thus conceived is susceptible to numerous modifications and variations all falling within the scope of the inventive idea. Furthermore, all the details may be substituted with technically equivalent elements.

In practice the materials as well as the dimensions may be any as required.

I claim:

1. A pneumatic cleaner, particularly for cleaning turbines of twisting machines, comprising a suction head having a suction duct and a front surface defining a conical suction mouth communicating with said suction duct, said conical suction mouth sloping from said front surface toward said suction duct, a nozzle inside said suction duct and means for connecting said nozzle to a source of compressed air, said nozzle being oriented to generate an air jet inside said suction duct directed opposite to said suction mouth for generating suction at said suction mouth and inside said suction duct, a first passage within said suction head separate from said suction duct and having an air blast nozzle opening substantially at the peripheral portion of said conical suction mouth and directed with an axis crossing the axis of said conical suction mouth at a point outside of said suction head for creating an air jet centrally oriented into the object to be cleaned, a second passage within said suction head separate from said first passage and from said suction duct and having an air blast nozzle opening into said conical suction mouth in a direction inclined with respect to said front surface and having an axis skew with respect to the axis of said conical suction mouth for creating a vortical air movement inside the object to be cleaned, means for connecting said first and second passage to a source of compressed air, means on said front surface for geometrical connection of said head with the object to be cleaned, and a collecting container at the outlet of said suction duct, whereby simultaneous air ejection from said air blast nozzles causes vortical dislodgement of foreign material from the object to be cleaned to the center thereof while air ejection from said nozzle inside said suction duct causes suction of the dislodged material through said suction duct to said collecting container.

* * * * *